US008925184B2

(12) United States Patent
Condliff

(10) Patent No.: US 8,925,184 B2
(45) Date of Patent: Jan. 6, 2015

(54) ROBOTIC END EFFECTOR AND CLAMPING METHOD

(75) Inventor: Christopher D. Condliff, Issaquah, WA (US)

(73) Assignee: The Boeing Company, Chicago, IL (US)

( * ) Notice: Subject to any disclaimer, the term of this patent is extended or adjusted under 35 U.S.C. 154(b) by 389 days.

(21) Appl. No.: 13/313,784

(22) Filed: Dec. 7, 2011

(65) Prior Publication Data

US 2012/0080897 A1 Apr. 5, 2012

Related U.S. Application Data

(60) Division of application No. 11/924,802, filed on Oct. 26, 2007, now Pat. No. 8,096,038, and a continuation-in-part of application No. 11/747,563, filed on May 11, 2007, now Pat. No. 8,549,723.

(51) Int. Cl.

| | |
|---|---|
| ***B23P 21/00*** | (2006.01) |
| ***B25J 15/00*** | (2006.01) |
| ***B21J 15/28*** | (2006.01) |
| ***B21J 15/02*** | (2006.01) |
| ***B21J 15/10*** | (2006.01) |

(52) U.S. Cl.

CPC *B21J 15/02* (2013.01); *B21J 15/28* (2013.01); *B21J 15/10* (2013.01)

USPC ..... 29/715; 294/213

(58) Field of Classification Search

USPC ..... 29/715, 505, 521, 534.1, 525.06, 714; 294/213, 104; 901/36

See application file for complete search history.

(56) References Cited

U.S. PATENT DOCUMENTS

| | | | | |
|---|---|---|---|---|
| 4,885,836 | A | 12/1989 | Bonomi et al. | |
| 4,955,119 | A * | 9/1990 | Bonomi et al. | 29/50 |
| 6,062,458 | A | 5/2000 | Edwards | |
| 6,949,057 | B2 | 9/2005 | Everson et al. | |
| 8,096,038 | B2 | 1/2012 | Condliff | |
| 8,549,723 | B2 | 10/2013 | Condliff | |
| 2001/0039718 | A1 | 11/2001 | Mauer et al. | |
| 2006/0027541 | A1 | 2/2006 | Sun et al. | |
| 2008/0277953 | A1 | 11/2008 | Condliff | |
| 2012/0080897 | A1 | 4/2012 | Condliff | |
| 2012/0210802 | A1 | 8/2012 | Sarh et al. | |
| 2013/0031764 | A1 | 2/2013 | Sarh et al. | |
| 2013/0185925 | A1 | 7/2013 | Sarh et al. | |

FOREIGN PATENT DOCUMENTS

| | | |
|---|---|---|
| WO | WO9402264 | 2/1994 |

OTHER PUBLICATIONS

UK Intellectual Property Office; Combined Search and Examination Report for GB0808567.2 dated Aug. 22, 2008.

* cited by examiner

*Primary Examiner* — John C Hong
(74) *Attorney, Agent, or Firm* — Parsons Behle & Latimer

(57) ABSTRACT

An end effector for use on a robotic arm includes a clamping assembly for clamping a workpiece, and a tool such as a drill for performing an operation on the clamped workpiece. The clamping assembly is slidably mounted on the robotic arm and self adjusts its position relative to the workpiece before a clamping operation is performed. Linear actuators independently control the movements of the clamping members. The actuators are operated by a controller, based in part on position information produced by sensors that sense the position of the clamping members.

18 Claims, 12 Drawing Sheets

ROBOTIC END EFFECTOR AND CLAMPING METHOD

CROSS REFERENCE TO RELATED APPLICATIONS

This application is a continuation-in-part of U.S. patent application Ser. No. 11/747,563, filed May 11, 2007, the entire disclosure of which is incorporated by reference herein.

This is a Divisional of a co-pending application Ser. No. 11/924,802, filed on 10/26/2007.

TECHNICAL FIELD

This disclosure generally relates to end effectors for robots, and deals more particularly with an end effector and related method for clamping and drilling a workpiece.

BACKGROUND

End effectors may be mounted on robotic arms to carry out any of various operations on workpieces. For example, in the aerospace industry, an end effector may include clamping and drilling tools for forming holes in aircraft subassemblies. The robotic arm moves the end effector to a position in which a pair of opposing clamping jaws are disposed on opposite sides of the workpiece. The jaws are closed to clamp the workpiece, following which a drilling operation may be performed.

A robotic end effector of the type described above requires the robot to position the clamping jaws around the workpiece with relative accuracy. Inaccurate positioning of the jaws may result in one of the jaws engaging and applying force to the workpiece before the other jaw is fully closed. This uneven application of force may result in slight displacement of the workpiece, or excessive force being applied to the workpiece, producing less than optimum results. In addition to the possibility of inaccurate placement of the robotic arm, part-to-part variations in the workpiece or inaccurate positioning of the workpiece in fixturing may also result in the workpiece not being accurately positioned between the clamping jaws. Thus, current end effectors and clamping techniques rely on relatively accurate positioning of the end effector, as well as accurate location of the workpiece.

Accordingly, there is a need for a robotic end effector and clamping method that overcome the problems mentioned above, and allow clamping a workpiece where a robotic arm may not be precisely positioned or variations may occur in the workpieces or their positioning. Embodiments of the present disclosure are intended to provide a solution to these problems.

SUMMARY

Embodiments of the disclosure provide a robotic end effector and clamping method that reduce the need for precise positioning of either a robotic arm or the workpiece. The end effector includes a feature that adjusts the position of clamping members relative to a workpiece, even when variations occur in the final placement of the robotic arm, the position of the workpiece, or part-to-part variations in the workpieces causing variations in the location of workpiece features. Self adjustment of the clamping members reduces the possibility that excess clamping force may be applied to a workpiece or that the workpiece will be displaced in a manner that may adversely affect an operation such as hole drilling.

According to one method embodiment, clamping a workpiece using an end effector mounted on the end of a robotic arm comprises the steps of: positioning first and second clamping members on opposite side of a workpiece; moving the first clamping member into engagement with the workpiece while the arm remains stationary; and, then, moving the second clamping member into engagement with the workpiece while the are remains stationary. The first clamping member is moved into engagement with the workpiece by linearly displacing a frame relative to the robotic arm. The second clamping member is moved into engagement with the workpiece by displacing the second clamping member relative to the frame. Displacement of the clamping members may be performed by motors, such as fluid cylinders.

According to another disclosed method embodiment, clamping a workpiece comprises the steps of: mounting a frame on the end of a robotic arm; mounting first and second clamping members on the frame; positioning the workpiece between the first and second clamping members; moving the first clamping member into engagement with the workpiece by moving the frame relative to the robotic arm; and, moving the second clamping member relative to the frame into engagement with the workpiece. The first clamping member is moved into engagement with the workpiece by sliding the frame linearly on the end of the robotic arm.

According to another disclosed embodiment, robotic apparatus comprises a robotically controlled arm; a frame mounted on the arm for movement along a reference axis; and, first and second opposed clamping members for clamping a workpiece, the first clamping member being secured to the frame and the second clamping member being mounted on the frame for movement toward and away from the first clamping member in a direction parallel to the reference axis. The frame may be slideable on the robotic arm and the second clamping member may be slideable on the frame. First and second linear power drives may be provided for respectively moving the frame and the second clamping member in direction parallel to the reference axis. The second clamping member may include a slide plate slideably mounted on the frame, and a jaw mounted on the slide plate. The apparatus may further include a drill mounted on the frame for performing a drilling operation on the workpiece. Sensors may be provided for sensing the of the frame relative to the arm.

According to another embodiment, a self adjusting end effector for use with a robotic arm, comprises: a clamping assembly including first and second clamping members between which the workpiece may be clamped; a mounting device for adjustably mounting the clamping assembly on the robotic arm and allowing linear movement of the clamping assembly independent of the robotic arm; and, at least one tool for performing an operation on the workpiece. The mounting device may include a frame assembly having first and second frame portions, and the first and second clamping members may be respectively mounted on the first and second frame portions. The mounting device may further include a slide which is used to mount the first frame portion on the robotic arm. The second frame portion may be slideably mounted on the first frame portion.

Other features, benefits and advantages of the disclosed embodiments will become apparent from the following description of embodiments, when viewed in accordance with the attached drawings and appended claims.

BRIEF DESCRIPTION OF THE ILLUSTRATIONS

DETAILED DESCRIPTION

Figure 1:
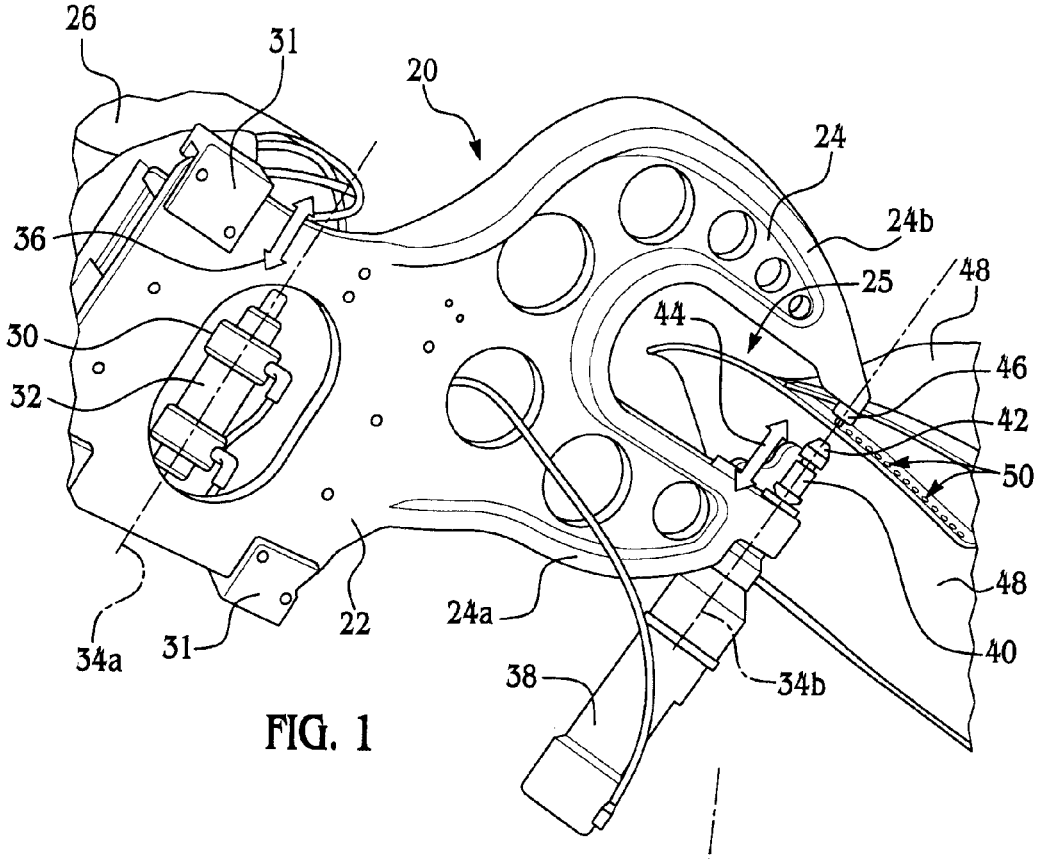
FIG. 1 is a perspective illustration of an end effector for squeezing fasteners, and showing a workpiece positioned between the jaws of the end effector.
Figure 2:
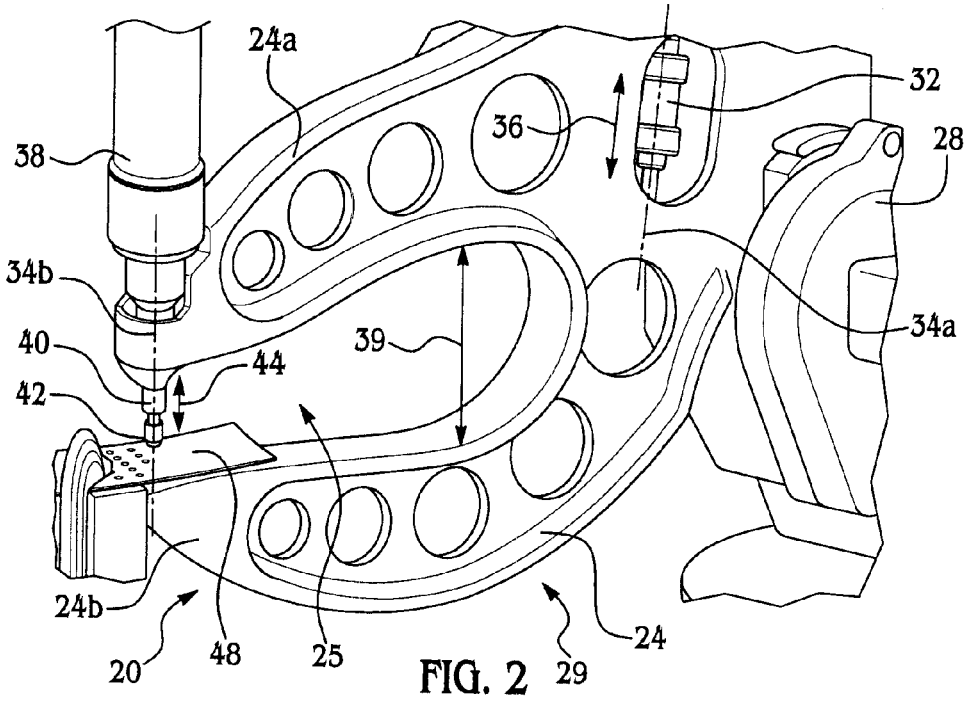
FIG. 2 is a perspective illustration of an end effector similar to FIG. 1, but showing a different workpiece positioned between the jaws.

Referring first to FIGS. 1-4, an end effector is provided for squeezing parts, such as rivets 50 used to join workpieces 48, which in the illustrated example, comprise metal sheets. The end effector 20 includes a C-shape frame 24 slidably mounted on the arm 26 of a robot 28 for linear movement in the direction of the arrow 36, along an axis 34*a* that is substantially parallel to the longitudinal axis of a rivet 50 to be squeezed.

Figure 3:
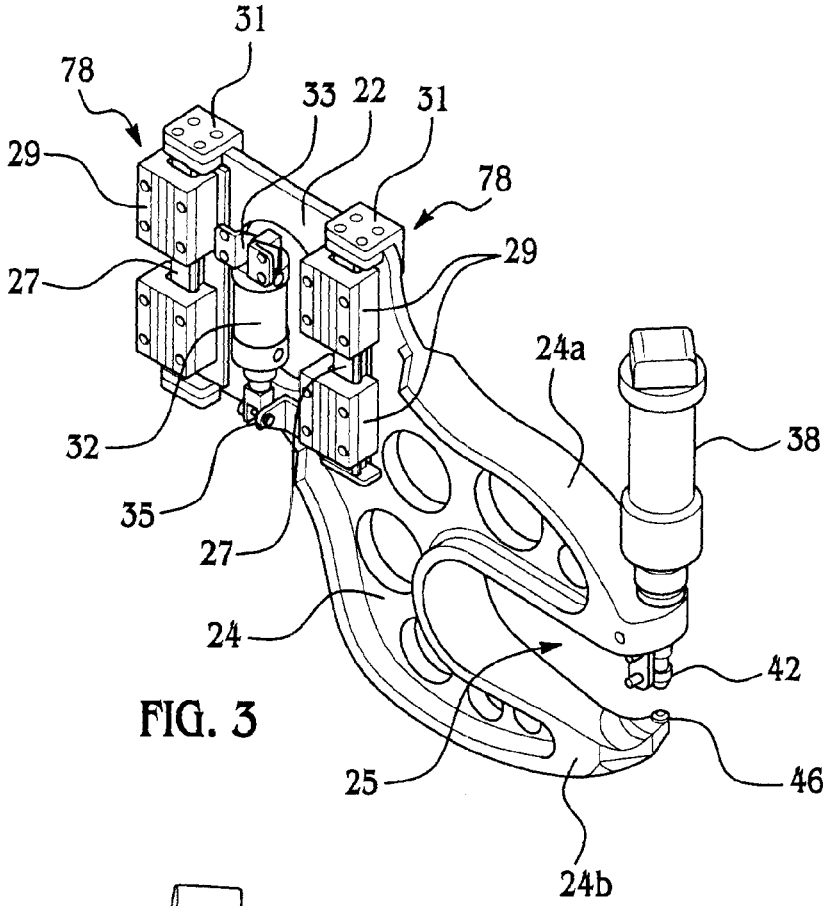
FIG. 3 is a perspective illustration showing one side of the end effector illustrated in FIG. 1.

As best seen in FIG. 3, the end effector 20 is mounted on the robotic arm 26 (FIG. 1) by means of a slide assembly 78, comprising a pair of parallel guide rails 27 secured to a rear plate portion 22 of the frame 24, and four roller bearing blocks 29. The roller bearing blocks 29 are secured to the robotic arm 26 and are slidable on the rails 27. Depending upon the configuration of the robotic arm 26, an adapter plate (not shown) may be installed between the roller bearing blocks 29 and the arm 26.

A biasing device 32 has one end thereof connected to the robotic arm 26 by a bracket 33, and the other end thereof connected to the rear plate portion 22 by means of a clevis 35. The biasing device 32 may comprise a pneumatic cylinder in the illustrated embodiment; however other forms of biasing means are contemplated including, without limitation, electromagnetic, hydraulic or mechanical devices, such as a simple spring. The biasing device 32 provides a counterbalancing force that normally urges the end effector 20 to be displaced along axis 34*a* to a standby position shown by the numeral 37 in FIG. 9, when a rivet squeeze operation is not being performed.

Figure 4:
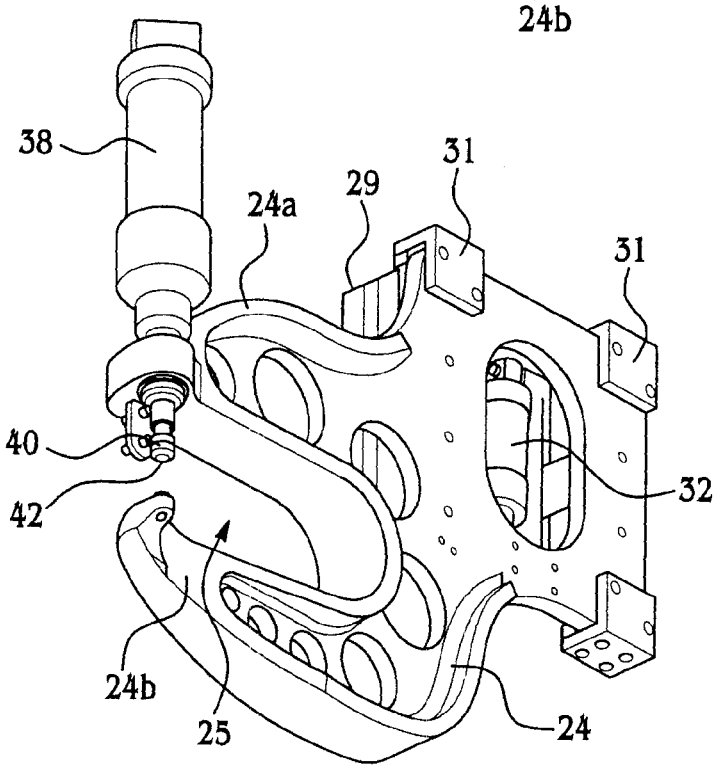
FIG. 4 is a perspective illustration similar to FIG. 3 but showing the opposite side of the end effector.

A frame position sensing device 54 (FIG. 10) such as an inductive sensor, may be employed to sense when the C-shape frame 24 is in its standby position 37. Two actuator position sensors 55 (FIG. 10) may be provided to sense when the actuator is fully retracted and fully extended, respectively. The position information developed by the sensors 54, 55 may be used by the controller 52 to coordinate the movements of the robot 28. As best seen in FIGS. 3 and 4, the end stops 31 mounted on the plate portion or on an adapter plate (not shown) engage the roller bearing blocks 29 in order to limit the movement of the frame 24 to two extreme positions of sliding movement.

As shown in FIGS. 1-4, the C-shape frame 24 includes a pair of opposing jaws 24*a*, 24*b* defining an open throat 25 that may receive portions of a workpiece that are to be riveted. The C-shape frame 24 may be formed from any suitably rigid material such as, without limitation, high strength steel, aircraft grade aluminum, titanium or a composite material. The frame 24 may have configurations other than C-shape, providing the frame has a pair of opposing jaws 24*a*, 24*b*. The depth 39 (see FIG. 2) of the throat 25 should be sufficient to accommodate the workpieces to be riveted.

A linear actuator 38 is mounted on jaw 24*a* which may comprise a conventional, commercially available pneumatic, hydraulic or electromagnetic cylinder having a linearly displaceable output shaft 40. A tool 42 which may be in the form of a flat anvil 42 is mounted on the end of the shaft 40, and is intended to engage the factory head of the rivet 50. In one embodiment, the shaft 40 and anvil 42 are linearly displaceable in the direction of the arrow 44 shown in FIG. 2 along an axis 34*b*. As best seen in FIGS. 1 and 4, the other jaw 24*b* may include a button forming die tool 46 which is intended to engage and upset or buck the bucktail end of the rivet 50. The exact configuration of the die tool 46 will depend upon the shape of the button that is to be formed.

Figure 10:
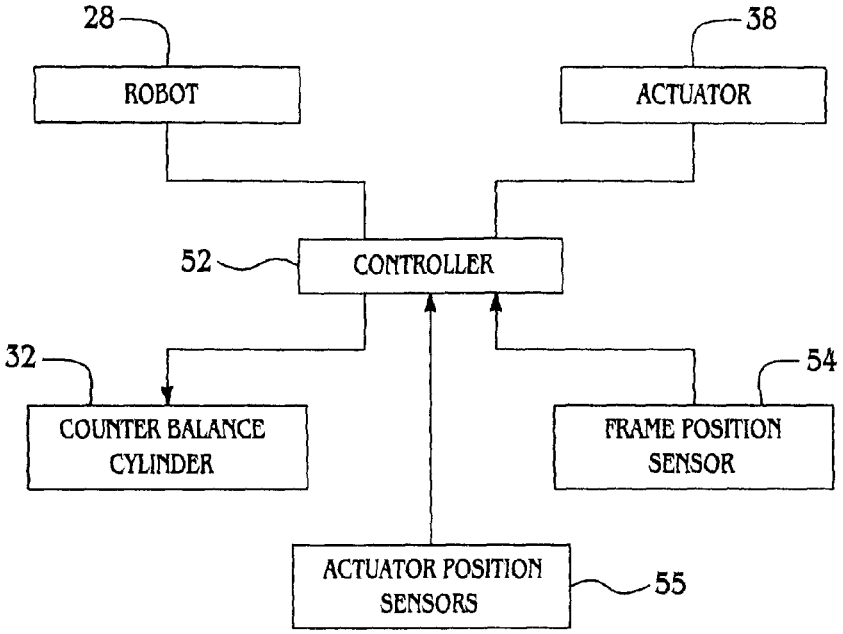
FIG. 10 is a broad block illustration of a system for controlling the end effector.

Referring to FIG. 10, a controller 52 which may be a programmed computer or PLC (programmable logic controller), is used to control and coordinate the operation of the robot 28 and the linear actuator 38 in order to upset the rivets 50. The controller 52 may also be operative to control the counterbalancing pressure applied by the cylinder 32. The controller receives position signals from the frame sensor 54 in a feedback loop that is used to control the precise position of the robotic arm 26 forming part of the robot 28.

Figure 5:
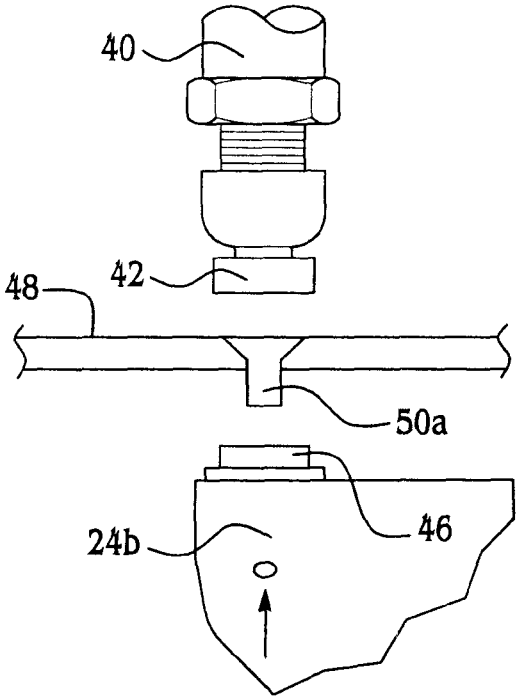
FIGS. 5-9 illustrate the successive movements of tools on the opposing jaws of the end effector shown in FIG. 1, during the process of upsetting a rivet.
Figure 11:
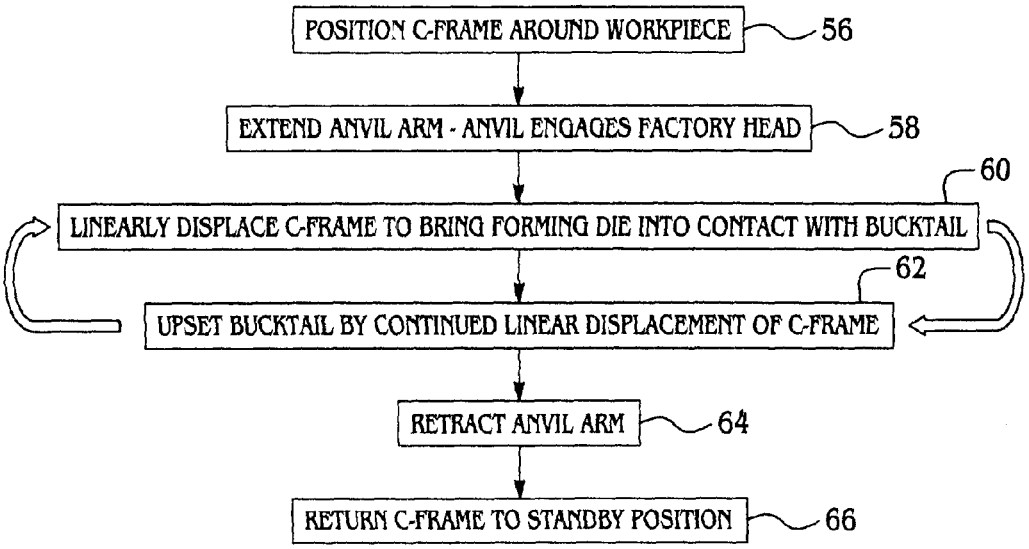
FIG. 11 is a broad block diagram illustrating the steps of a method for squeezing a fastener according to a method embodiment.

Referring now concurrently to all the figures, the first step in squeezing a rivet 50 using the end effector 20 is shown at step 56 in FIG. 11 in which the C-shape frame 24 is positioned around the workpiece 48 so that the anvil 42 and the die 46 are axially aligned on opposite ends of the rivet 50. The controller 52 is programmed with an offset, so that a minimal clearance is present between the ends of the rivet 50 and the anvil and the die 46. This offset assures that there is no physical interference with the rivet 50 as the robot initially positions the jaws 24*a*, 24*b* around the workpiece 48. The initial starting position represented by step 56 is shown in FIG. 5, wherein the actuator shaft 40 and anvil 42 are in their retracted positions.

Figure 6:
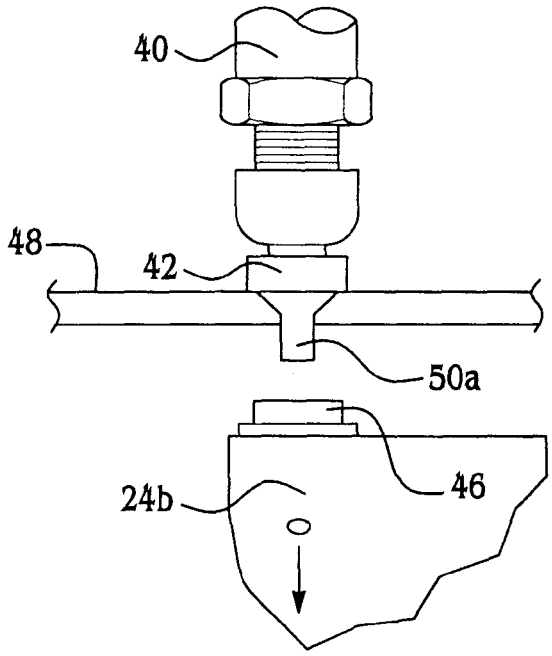

Next, at step 58 (FIG. 11), the controller 52 energizes the actuator 38, causing the shaft 40 and anvil 42 to be displaced forward into engagement with the factory head of the rivet 50. During the forward movement of the anvil 42, the die 46 remains stationary. The positions of the anvil 42 and the die 48 after the completion of step 58 are shown in FIG. 6. The anvil engages the factory head and maintains it flush with the outer surface of the workpiece 48. It should be noted here that the end effector 20 and clamping method may also be used to install rivets that are not countersunk in the workpiece 48. The frame 24 remains in its standby position 37 under the biased influence of the biasing device 32.

Figure 7:
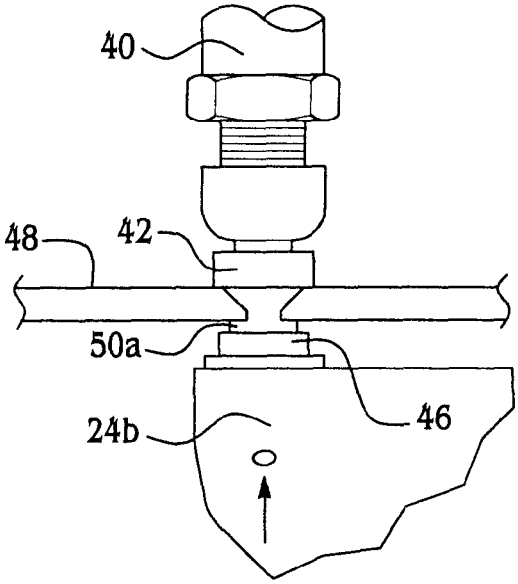

After the anvil 42 has engaged the factory head of the rivet 50, continued extension of the actuator shaft 40 transmits a reactive force to the frame 24 as a result of the actuator 30 being mounted on the jaw 24*a*. As a result of this reactive force, the frame 24 begins translating along axis 34*a*, thereby displacing the die 46 toward the bottom end of the bucktail 50*a*, as shown at step 60 in FIG. 11. At step 62, continued linear displacement of the frame results in the die 46 contacting and deforming the bucktail 50*a* into a button, thereby upsetting the rivet 50 in place, as shown in FIG. 7. Throughout the movement of the frame 24 in step 62, the anvil 42 remains engaged with the factory head of the rivet 50.

It should be noted here that steps 58 and 60 can be reversed, if desired. Thus, the robot 28 may move the C-shape frame 24 to bring the forming die 46 into close proximity or initial contact with the bucktail 50*a*. Then, the controller 52 may energize the actuator 38, resulting in the displacement of shaft 40 until the anvil 42 engages the factory head of the rivet 50, following which continued extension of shaft 40 results in a reactive force that is transmitted through the jaw 24*b*, causing the die 46 to deform the bucktail 50*a*.

Figure 8:
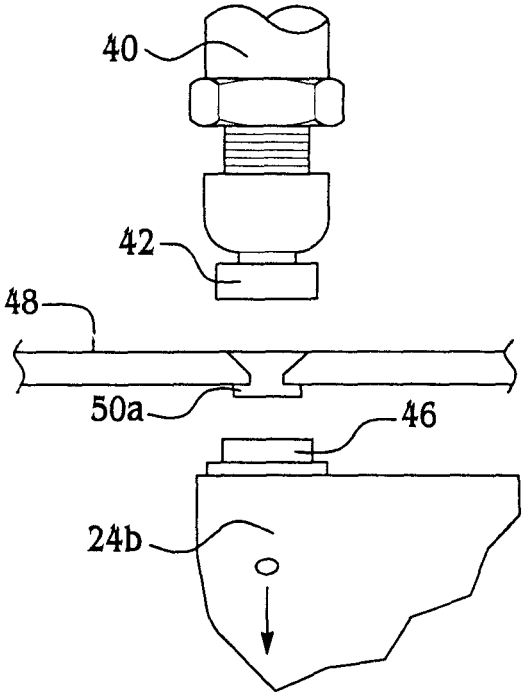
Figure 9:
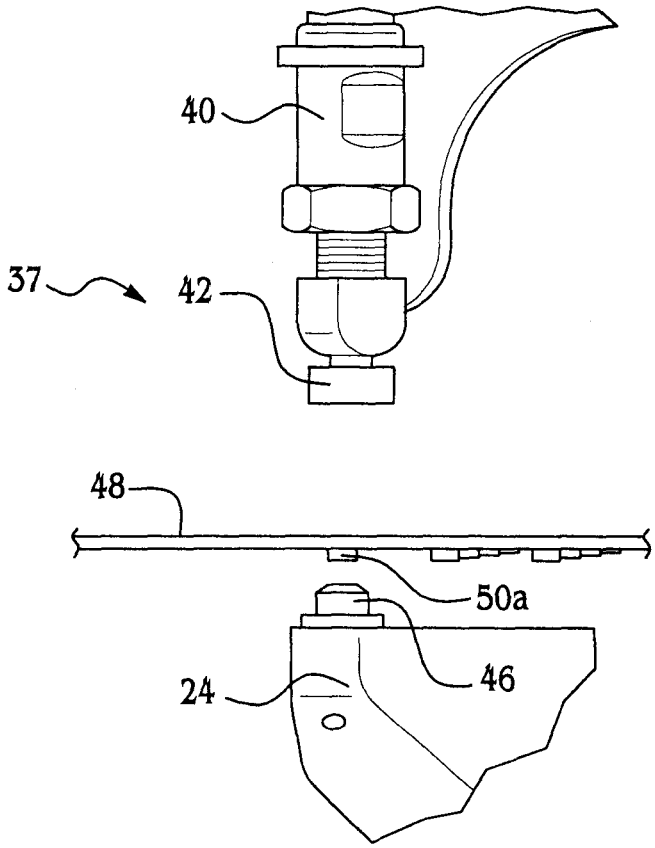

As the actuator shaft 40 begins to retract as shown in step 64 and illustrated in FIG. 8, the reactive force transmitted through the frame 24 produced by the actuator 38 is relieved, which results in the biasing device 32 causing the frame 24 to translate back to its standby position 37. The partial retraction of the anvil arm 40 is shown at FIG. 8, in which the frame 24 and thus the die 46 have returned to the standby position 37. The return of the frame 24 to the standby position 37 is shown at step 66 in FIG. 11 and is also illustrated in FIG. 9.

In the disclosed embodiment, the counterbalancing effect provided by the biasing device 32 should be sufficient in magnitude to overcome gravitational force when the axis 34*a* of movement is vertically oriented. Further, the counterbalancing force exerted by the biasing device 32 should be sufficient to maintain the frame 24 in its standby position 37 while being moved and positioned to a rivet location by the robot 28. However, the force imposed on the frame 24 by the biasing device 32 should not be so great that it adversely affects the rivet squeezing process. In other words, the frame 24 should effectively be "free-floating on the slide assembly so that a material lateral force is not imposed on the tools (anvil 42 and die 46) during the rivet squeeze process. The magnitude of the counterbalancing force exerted by the biasing device 32 may be adjusted by the controller 52, depending upon the attitude of the end effector 20, and/or can be eliminated or maintained during the rivet upset process, as may be required in a particular application.

In some applications, the biasing device 32 may not be required. For example, in an application where the frame 24 is maintained in an attitude such that the axis 34*a* is vertical, gravity will provide the force necessary to return the frame 24 to its standby position 37. In such an application, the force developed by the actuator 38 would have to be sufficient to effectively "lift" the frame 24 from its standby position 37 and complete the squeeze process.

From the forgoing, it may be appreciated that the end effector 20 described above may provide successful rivet upsetting within close quarters as a result of several features. By placing the linear actuator 38 on the jaw 24*b* (see FIG. 1, for example), that faces the manufactured head of the rivet 50, interference with structures on the backside of the workpiece 48 may be avoided.

Further, by slidably mounting the frame 24 on the robotic arm 26 using a linear slide assembly 78 (FIG. 12), the C-shape frame 24 is allowed to translate linearly as the actuator arm 40 extends and retracts during the rivet upsetting cycle carried out in steps 58-64 shown in FIG. 11.

Finally, the use of a counterbalance provided by the biasing device 32 offsets the weight of the end effector 20 as the rivet 50 is being upset, resulting in a minimum amount of force being transmitted to the workpiece 48 and in any fixture/jigs that may be supporting it. The counterbalance force provided by the biasing device 32 also maintains the frame 24 against stops 112 when in the standby position 37. This feature prevents the end effector 20 from sliding freely along axis 34 during changes in attitude of the end effector 20, when moving between rivet locations, and ensures that the die 46 is precisely aligned along the longitudinal axis of the rivet 50, and therefore is in a known location when being positioned on a rivet 50.

Figure 12:
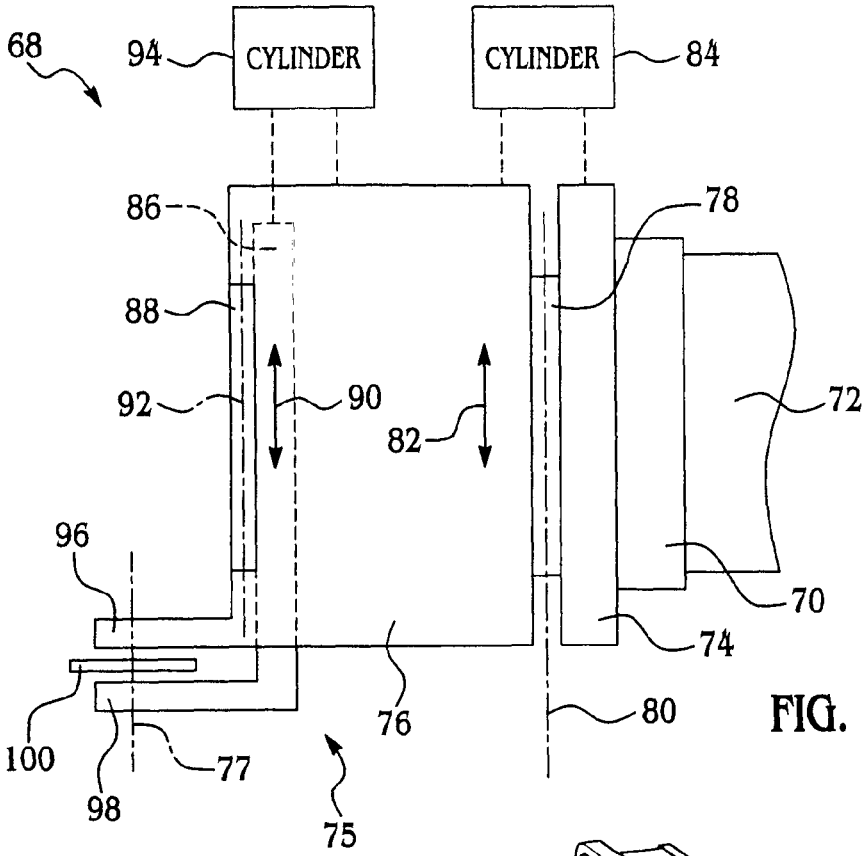
FIG. 12 is a functional diagram of an end effector forming an embodiment that may be used to perform workpiece clamping.

The features of the end effector 20 described above may be advantageously used to clamp a part or workpiece while a separate operations such as drilling or milling are performed on the workpiece. For example, as shown in FIG. 12, an end effector 68 may be mounted on the end of a robotic arm 72 by means of an adaptor 70 and a mounting plate 74. The end effector 68 includes a frame assembly 75 comprising an upper frame 76 and a lower frame 86. The upper frame 76 is mounted for linear movement in the direction of arrow 82 along an axis 80 by means of a slide assembly 78. Biasing means, which may comprise a fluid cylinder 84 is connected between mounting plate 74 and the upper frame 76 in order to bias the frame assembly 75 in one direction along the axis 80.

The lower frame 86 is mounted for linear movement in the direction of arrow 90 along axis 92 by means of slide assembly 88. Axes 80 and 92 extend substantially parallel to each other.

The upper frame 76 includes an outwardly extending clamping member in the form of an upper jaw 96. Similarly, the lower frame 86 includes an outwardly depending clamping member in the form of a lower jaw 98. Jaws 96, 98 oppose each other and are adapted to clamp a workpiece 100 therebetween upon which any of several of operations may be performed, such as milling, drilling, inspection, etc. A linear power drive, which may comprise, for example, without limitation, a fluid cylinder 94 is connected between the upper and lower frames 76, 86 and functions to move the lower jaw 98 toward or away from the upper jaw 96, along a clamping axis 77 which extends parallel to axes 80 and 92.

From the description immediately above, it can be appreciated that the frame assembly 75 is linearly displaceable along axis 80 independent of the robotic arm 72, and that the lower jaw 86 is displaceable along axis 92, independent of the position of the upper frame 76 or the robotic arm 72. As previously discussed in connection with the end effector 20 illustrated in FIGS. 1-9, the frame assembly 75 and thus the clamping jaws 96, 98 are adjustable relative to a workpiece 100, independent of the position of the robotic arm 72. Thus, once robotic arm 72 is moved into proximity to the workpiece 100, so that the workpiece 100 is generally disposed between jaws 96, 98, the linear position of the frame assembly 75 along axis 80 may be adjusted so as, thereby self-centering jaws 96, 98 around the workpiece 100.

Attention is now directed to FIGS. 13-20 which show additional details of the end effector 68. The adaptor 70 may be of a quick disconnect type suitable for mounting the end effector 68 on the end of the arm 72 (FIG. 12) of an NC, or CNC controlled robot (not shown) which functions to move the end effector 68 into proximity with locations on the workpiece 100 where operations are to be performed. In the illustrated example, the end effector 68 is adapted to perform drilling and countersinking operations on the workpiece 100, however a variety of other operations are contemplated that may require the workpiece 100 to be clamped.

The upper frame 76 is box shaped and includes rear and front frame plates 76*a*, 76*b*. The linear slide assembly 78 (FIG. 12) comprises a set of parallel rails 78*a* (FIG. 15) mounted on the rear frame plate 76*a*, and a set of bearing blocks 78*b* (FIG. 18) which are secured to the mounting plate 74 and ride on the rails 78*a*. Stops 112 may be attached to the rear frame plate 76*a* in order to limit the sliding movement of the frame assembly 75 relative to the mounting plate 74.

The slide assembly 88 may comprise a set of parallel rails 88*a* mounted on the rear face of frame plate 76*b*, which slideably receive bearing blocks 88*b* (FIG. 17) that are mounted on the lower frame 86. Stops 116 may be attached to the frame plate 76*b* (see FIGS. 14 and 15) in order to limit the sliding movement of the lower frame 86 relative to the upper frame 76.

Figure 18:
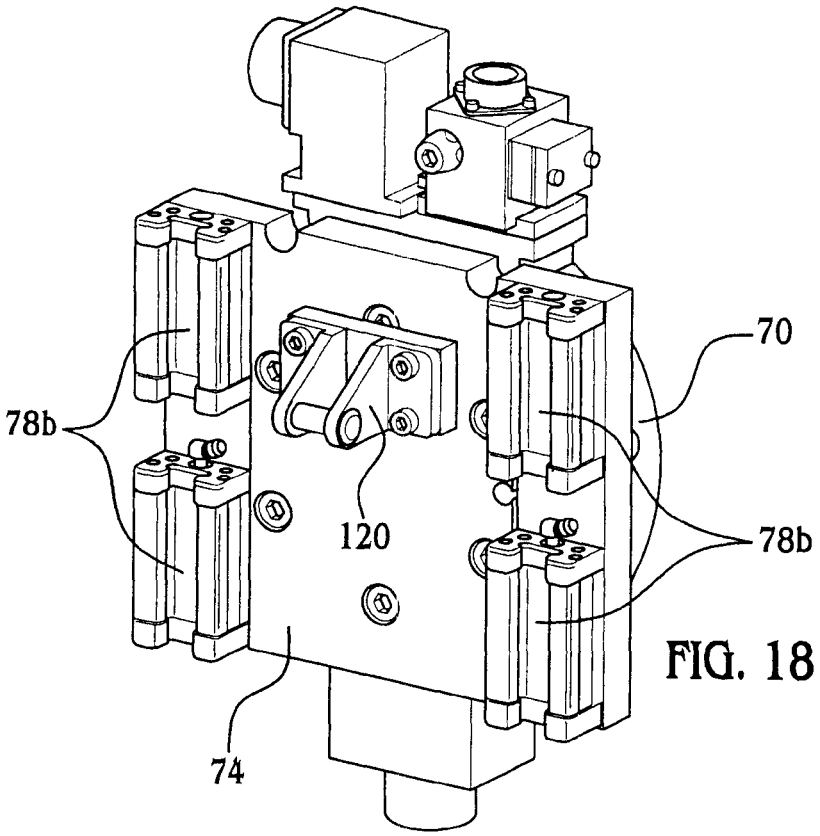
FIG. 18 is an isometric view illustrating one side of a mounting plate and adaptor.
Figure 19:
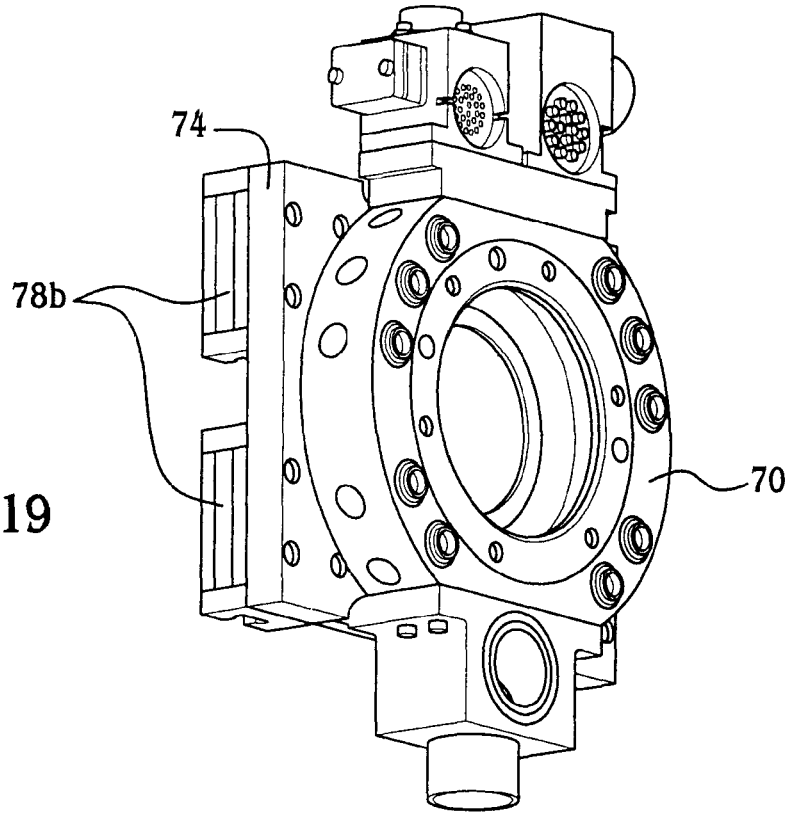
FIG. 19 is a view similar to FIG. 18, but showing the other side of the mounting plate and adaptor.

Fluid cylinder 84 has one end thereof pivotally connected by means of a bracket 17 to the frame plate 76*a*. The opposite end of cylinder 84 is pivotally connected to mounting plate 74 by means of a bracket 120 (FIG. 18). Similarly, cylinder 94 has one end thereof pivotally connected by a bracket 119 to the lower frame 86 (FIG. 16), while the opposite end of cylinder 94 is pivotally connected to frame plate 76 by bracket 114 (FIG. 15).

Figure 13:
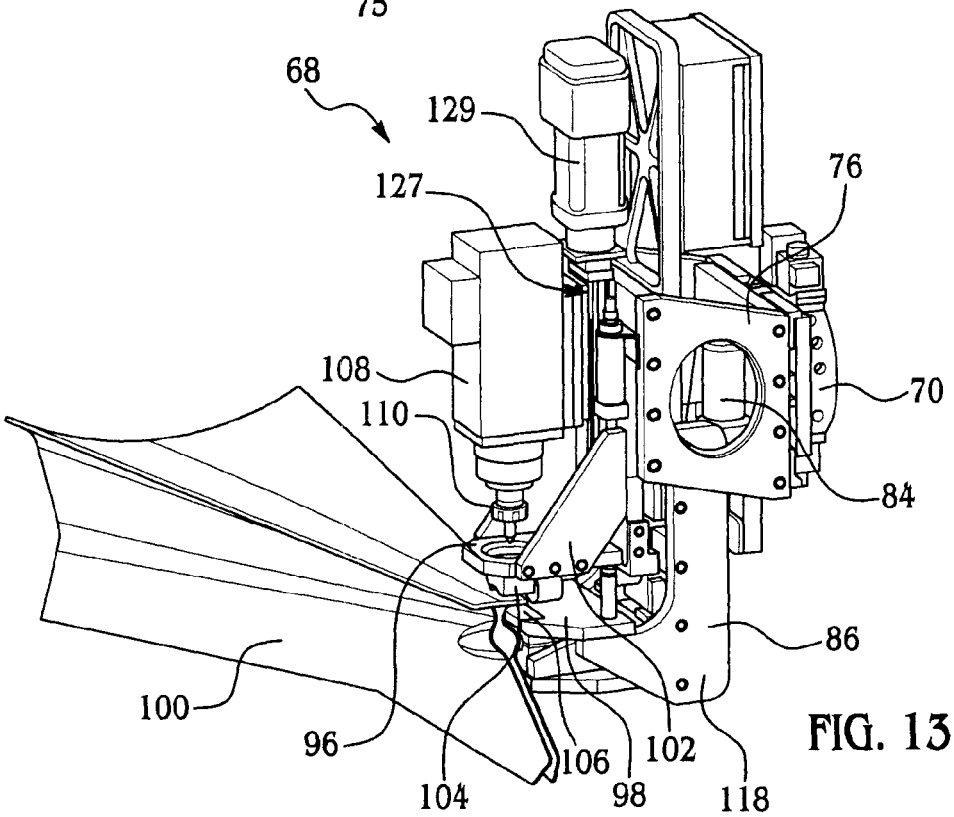
FIG. 13 is an isometric view of the end effector of FIG. 12, shown in relation to a workpiece.
Figure 14:
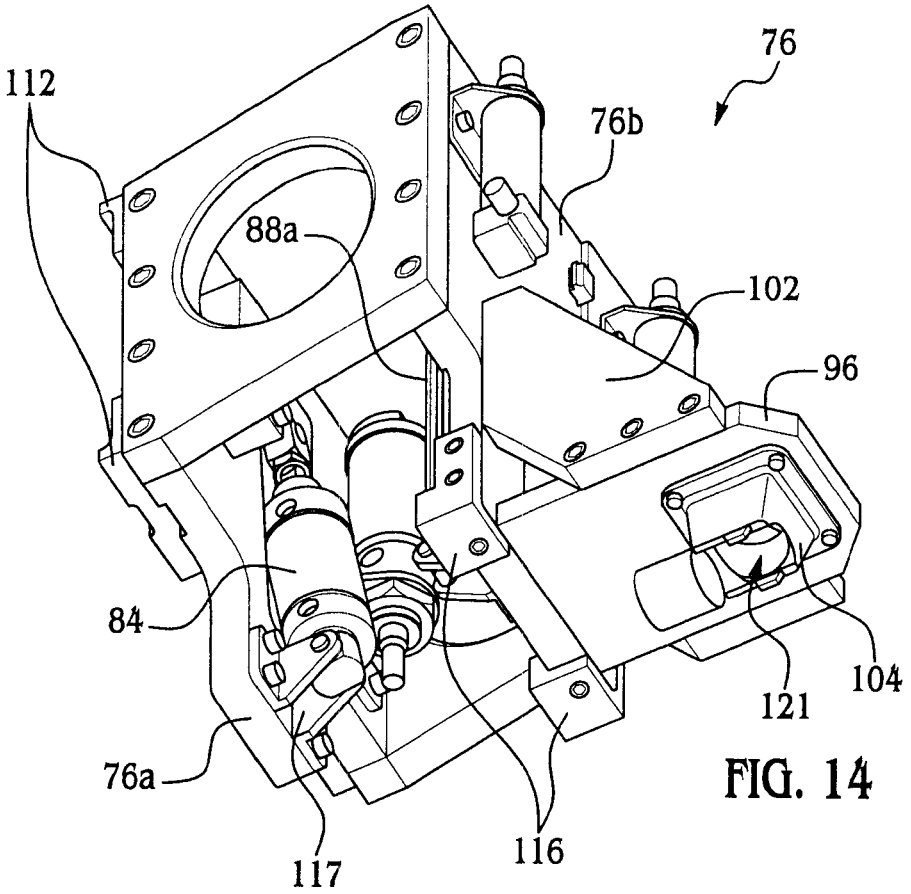
FIG. 14 is an isometric view of the upper frame forming a portion of the end effector shown in FIG. 13.
Figure 15:
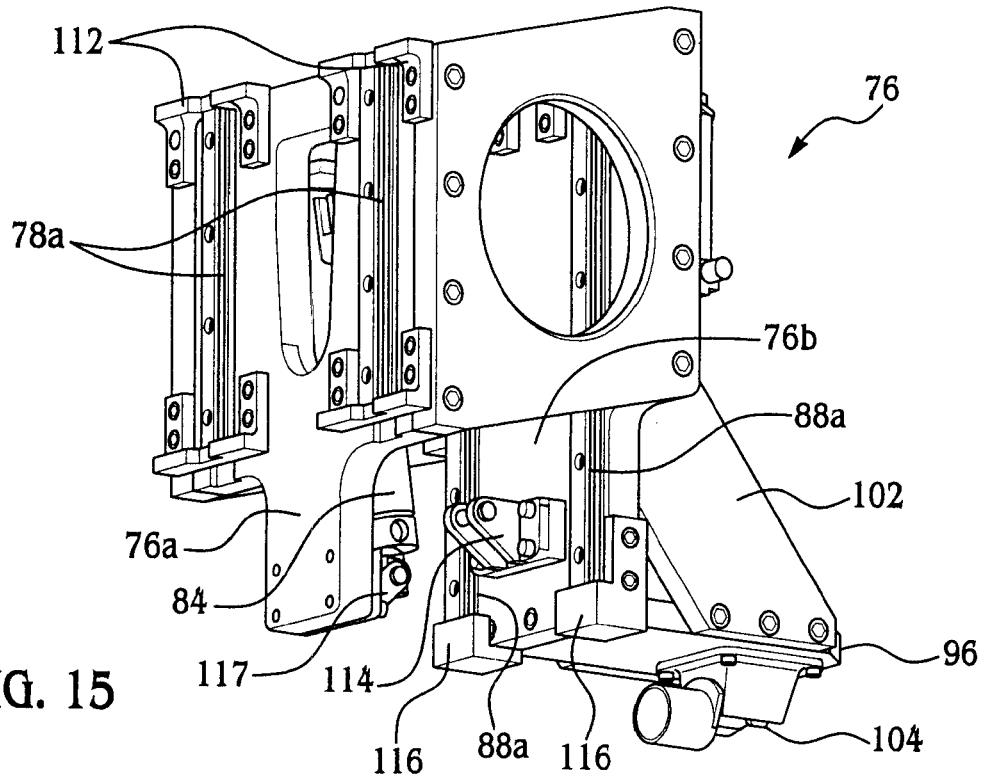
FIG. 15 is an isometric view of the upper frame, better depicting rails forming part of slides.
Figure 16:
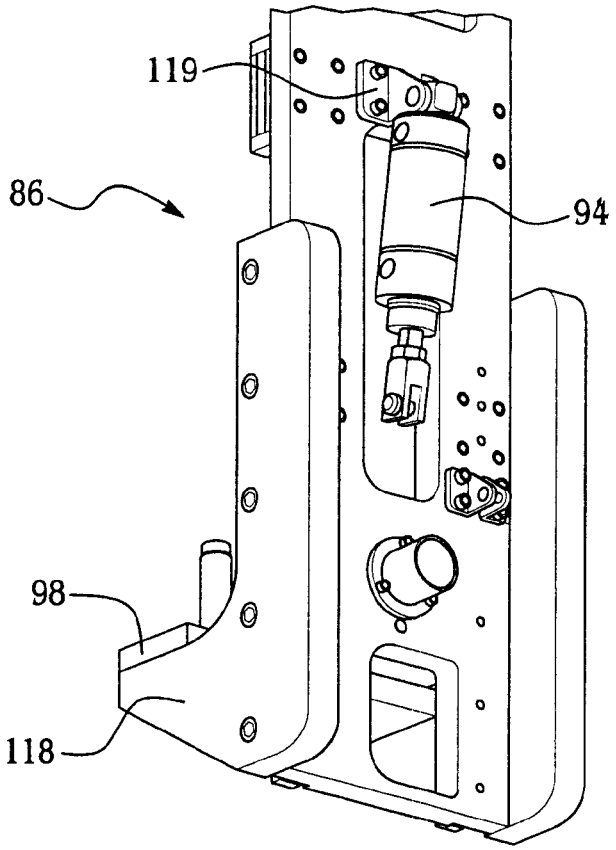
FIG. 16 is a fragmentary, isometric view of the backside of a lower frame.

As shown in FIGS. 13-15, the upper jaw 96 is attached to the frame plate 76*b* by means of a jaw support 102. The lower face of the upper jaw 96 includes an upper foot 104 which is adapted to engage and apply clamping force to the workpiece 100. The upper jaw 96 includes an opening 121 (FIG. 14) through which a tool such as a drill (not shown) may pass for performing operations on the workpiece 100.

Figure 17:
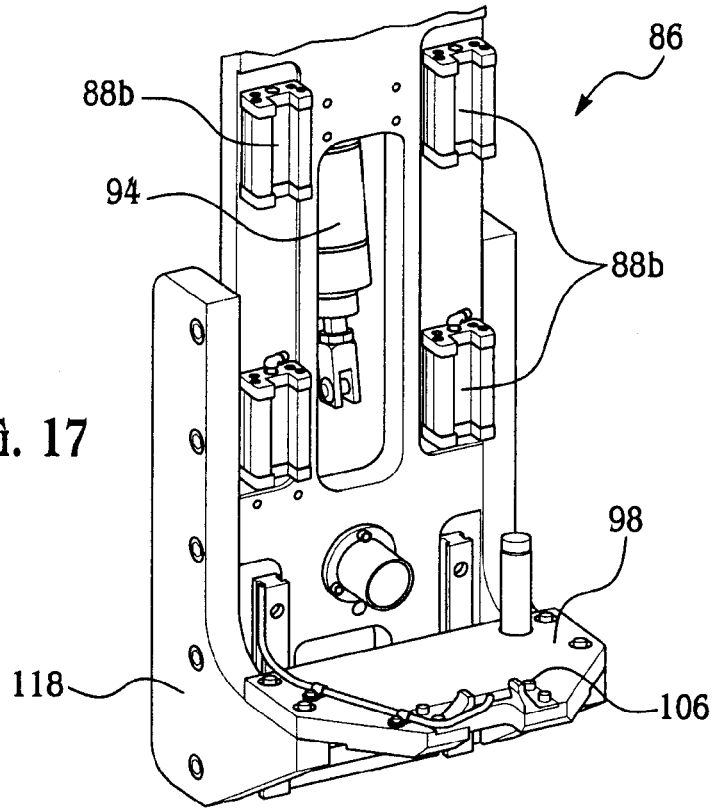
FIG. 17 is a view similar to FIG. 16, but showing the front side of the lower frame.

The lower jaw 98 is mounted on the lower frame 86 by means of a lower jaw support 118. Jaw 98 may include a lower foot 106 which is adapted to engage and apply clamping force to the workpiece 100 (FIGS. 13 and 17).

In the illustrated example, a tool motor 108 is mounted on the upper frame 76 and includes a tool head 110 for holding a tool such as a countersink drill (not shown). The tool motor 108 is mounted on the upper frame 76 by means of a guide assembly 127 which guides the movement of the tool motor 108, and thus the tool head 110, toward and away from the workpiece 100. The tool motor 108 may be displaced by a screw drive (not shown) powered by a motor 129 mounted on the upper frame 76.

Figure 20:
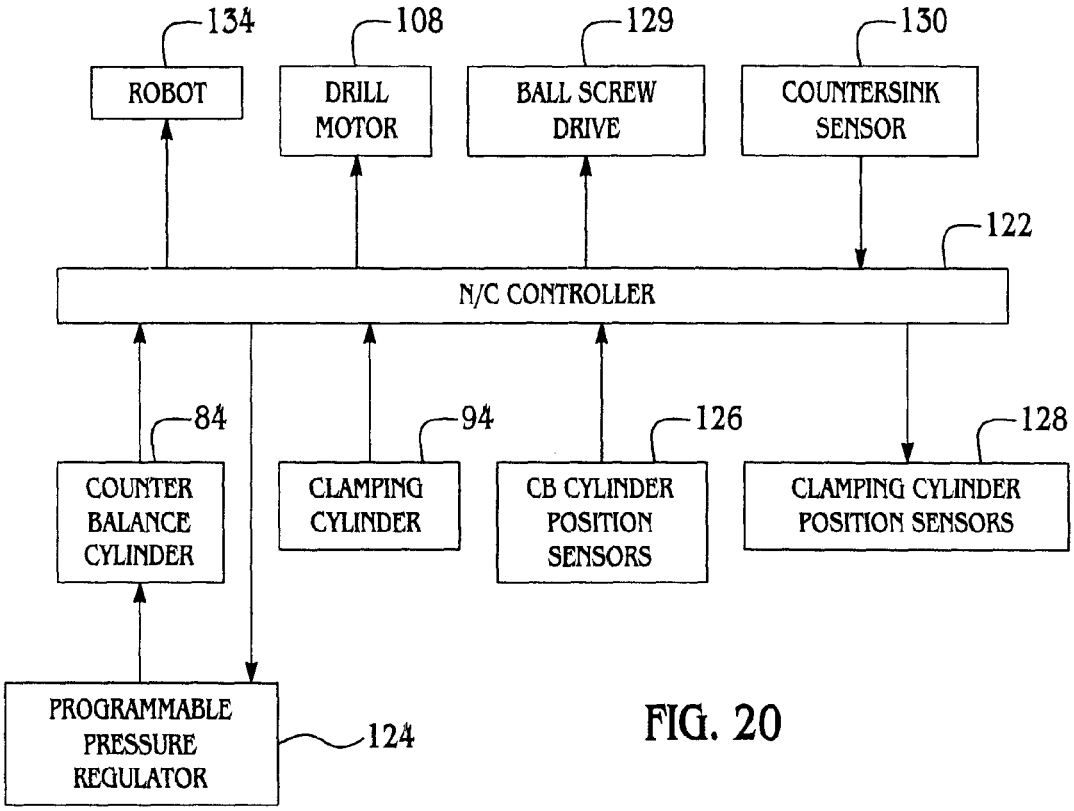
FIG. 20 is a functional block diagram illustrating components of the end effector and related control system.

Additional components of the end effector 68 are shown in FIG. 20. An NC controller 122 may control various functions on the end effector 68 (FIG. 13) and also controls the robot 134, including the robotic arm 72 (FIG. 12). Further, the NC controller 122 may control the operation of the drill motor 108, ball screw drive motor 129 and cylinders 84, 94. A programmable pressure regulator 124 may be provided which is controlled by the NC controller 122. The pressure regulator 124 effectively controls the biasing or counterbalance force applied to the frame assembly 75 by the cylinder 84. The control functions performed by the NC controller 122 may be based in part, on information derived from a variety of sensors on the end effector 68. For example, sensors 126, 128 may be mounted on the cylinders 84, 94 in order to sense the position of the cylinders and thus the positions of the upper and lower frames 76, 86. Alternatively, however, these sensors may be placed directly on the frames 76, 86 in order to sense their relative positions. Other sensors, such as a countersink sensor 130 may be provided to sense the depth of penetration, for example, of a countersink bit into the workpiece 100.

Figure 21:
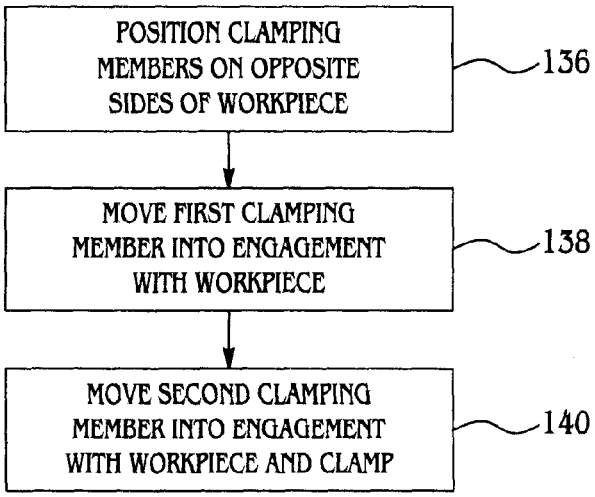
FIG. 21 is a flow diagram illustrating the basic steps of one method embodiment.

Attention is now directed to FIG. 21 which illustrates the broad steps of one method embodiment. Beginning at 136, clamping members comprising upper and lower jaws 96, 98 are positioned on opposite sides of the workpiece 100. Then, at step 138, the first clamping member comprising upper jaw 96 is moved into engagement with the workpiece 100. This movement may be performed by actuating the cylinder 84 which moves the frame assembly 76 along axis (FIG. 12) until the upper clamping foot 104 engages the surface of the workpiece 100. Finally, at step 140, the second clamping member comprising lower jaw 98 is moved into engagement with the workpiece 100 so as to clamp the workpiece between upper and lower jaws 96, 98. This movement may be accomplished by actuating the cylinder 94, which slides the lower frame upwardly to bring the lower foot 106 into engagement with the workpiece 100.

Figure 22:
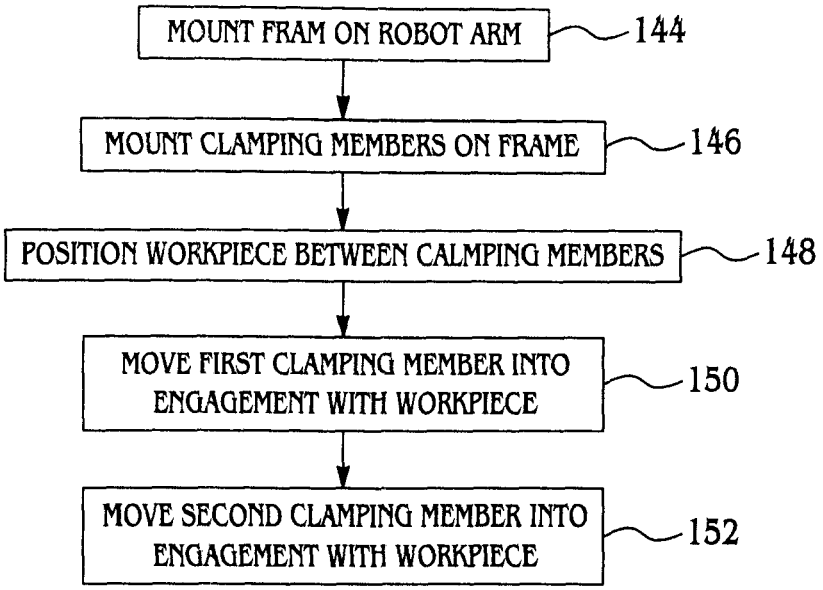
FIG. 22 is a flow diagram illustrating the basic steps of another method embodiment.

The broad steps of an alternate method embodiment are illustrated in FIG. 22. Beginning at step 144, the frame assembly 75 is mounted on the robotic arm 72, using the adaptor 70 and mounting plate 74. Next, at 146, clamping members, such as jaws 96, 98 and pressure feet 104, 106 are mounted on the frame assembly 75. At step 148, the workpiece 100 is then positioned between the clamping members, following which at 150, the first clamping member comprising the upper jaw 96 is moved into engagement with the workpiece 100. Finally, at step 152, the second clamping member comprising lower jaw 98 is moved into engagement with the workpiece 100, thereby clamping the workpiece 100 in preparation an operation such as drilling.

Figure 23:
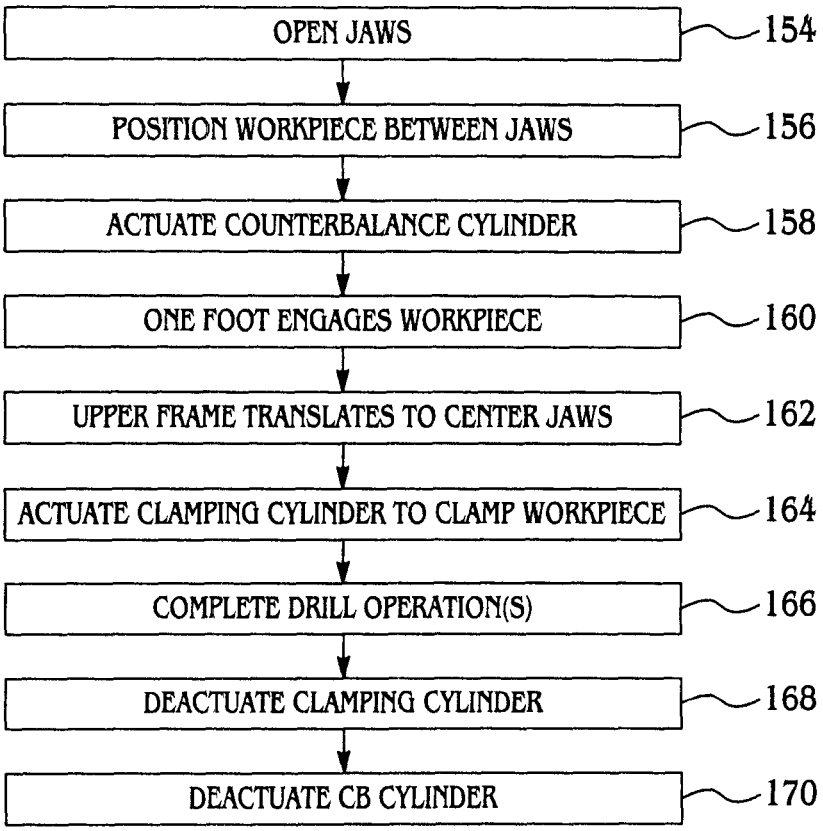
FIG. 23 is a flow diagram illustrating in more detail, the basic steps of a further method embodiment.

Details of a further method embodiment are shown in FIG. 23. Beginning at step 154, jaws 96, 98 are opened, following which a workpiece 100 is positioned between the jaws as shown at 156. Next, at 158, the counterbalance cylinder 84 is actuated resulting in the upper foot engaging the workpiece 100, as shown at step 160. At 162, the upper frame translates on the end of the robotic arm 72 in order to effectively center the jaws 96 98 relative to the workpiece 100. At 164 the clamping cylinder 94 is actuated, resulting in the other foot engaging and clamping the workpiece 100. With the workpiece having been clamped, an operation such as drilling operation is then performed at step 166, following which the clamping cylinder is deactuated to unclamp the workpiece 100. Then, the counterbalancing cylinder 84 is deactuated at step 170.

Figure 24:
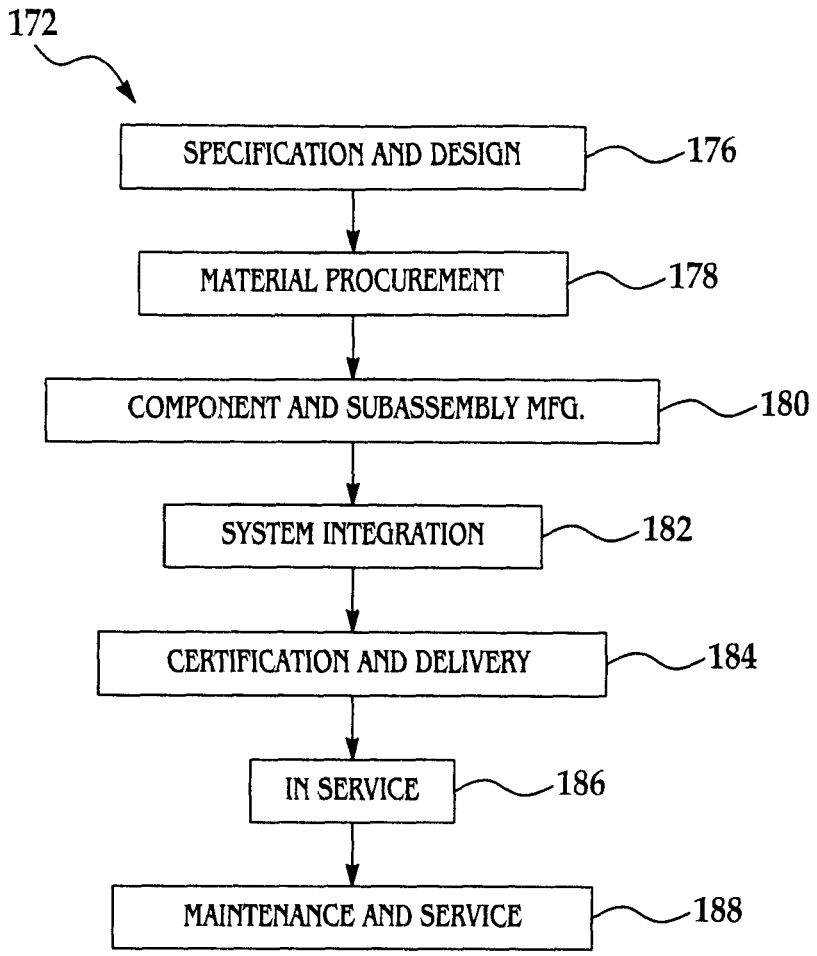
FIG. 24 is a flow diagram of aircraft production and service methodology.
Figure 25:
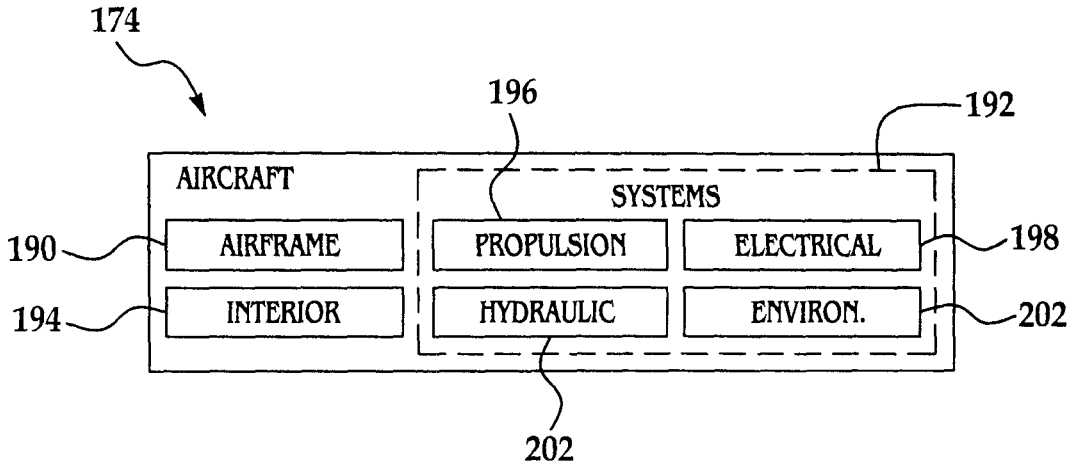
FIG. 25 is a block diagram of an aircraft.

Embodiments of the disclosure may find use in a variety of potential applications, particularly in the transportation industry, including for example, aerospace and automotive applications. Thus, referring now to FIGS. 24 and 25, embodiments of the disclosure may be used in the context of an aircraft manufacturing and service method 172 as shown in FIG. 24 and an aircraft 174 as shown in FIG. 25. Aircraft applications of the disclosed embodiments may include, for example, without limitation, composite stiffened members such as fuselage skins, wing skins, control surfaces, hatches, floor panels, door panels, access panels and empennages, to name a few. During pre-production, exemplary method 172 may include specification and design 176 of the aircraft 174 and material procurement 178. During production, component and subassembly manufacturing 180 and system integration 182 of the aircraft 174 takes place. Thereafter, the aircraft 174 may go through certification and delivery 150 in order to be placed in service 186. While in service by a customer, the aircraft 174 is scheduled for routine maintenance and service 188 (which may also include modification, reconfiguration, refurbishment, and so on).

Each of the processes of method 172 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 25, the aircraft 174 produced by exemplary method 172 may include an airframe 190 with a plurality of systems 192 and an interior 194. Examples of high-level systems 192 include one or more of a propulsion system 196, an electrical system 198, a hydraulic system 200, and an environmental system 202. Any number of other systems may be included. Although an aerospace example is shown, the principles of the disclosure may be applied to other industries, such as the automotive industry.

Apparatus and methods embodied herein may be employed during any one or more of the stages of the production and service method 172. For example, components or subassemblies corresponding to production process 146 may be fabricated or manufactured in a manner similar to components or subassemblies produced while the aircraft 140 is in service. Also, one or more apparatus embodiments, method embodiments, or a combination thereof may be utilized during the production stages 146 and 148, for example, by substantially expediting assembly of or reducing the cost of an aircraft 140. Similarly, one or more of apparatus embodiments, method embodiments, or a combination thereof may be utilized while the aircraft 140 is in service, for example and without limitation, to maintenance and service 154.

Although the embodiments of this disclosure have been described with respect to certain exemplary embodiments, it is to be understood that the specific embodiments are for purposes of illustration and not limitation, as other variations will occur to those of skill in the art. For example, although the disclosed embodiments have been described in connection with upsetting rivets, the embodiments may be employed to squeeze other parts, such as clamping workpiece parts.

What is claimed is:

1. An end effector for use with a robotic arm, comprising:

a mounting device, adjustably mountable on the robotic arm and independently linearly moveable along a first axis with respect to the robotic arm;

a clamping assembly, attached to the mounting device, including first and second clamping members between which a workpiece may be clamped, one of the first and second clamping members being linearly moveable in a direction parallel to the first axis;

a biasing device, attachable between the mounting device and the robotic arm, configured to counterbalance the mounting device with respect to the robotic arm, linear movement and contact of the one of the first and second clamping members with the workpiece causing opposing movement of the mounting device with respect to the robotic arm and contact of the other of the first and second clamping members with the workpiece, to apply clamping pressure to the workpiece; and, at least one tool, associated with one of the first and second clamping members, for performing an operation on the workpiece.

2. The end effector of claim 1, wherein:

the mounting device includes a frame assembly including first and second frame portions, and the first and second clamping members are respectively mounted on the first and second frame portions.

3. The end effector of claim 2, wherein:

the mounting device further includes a slide, and the first frame portion is slideably mounted on the robotic arm by the slide.

4. The end effector of claim 2, wherein the second frame portion is slideably mounted on the first frame portion.

5. The end effector of claim 2, further including sensing means for sensing positions of the first and second frame portions.

6. An end effector for use with a robotic arm, comprising:

a clamping assembly including first and second clamping members between which a workpiece may be clamped;

a mounting device for adjustably mounting the clamping assembly on the robotic arm and allowing linear movement of the clamping assembly independent of the robotic arm, the mounting device including a frame assembly having first and second frame portions wherein the second frame portion is slideably mounted on the first frame portion, and the first and second clamping members are respectively mounted on the first and second frame portions, the mounting device further including a slide, and wherein the first frame portion is slideably mounted on the robotic arm by the slide;

means for biasing the first frame portion to move linearly in one direction; and a drive connected with the second clamping member for moving the second clamping member into engagement with the workpiece, said engagement causing opposing linear motion of the first frame portion to bring the first clamping member into engagement with the workpiece, to apply a clamping pressure to the workpiece.

7. The end effector of claim 6, further comprising a sensor, configured for sensing relative positions of the first and second frame portions.

8. The end effector of claim 6, further comprising a sensor, configured for sensing relative positions of the first and second clamping members.

9. The end effector of claim 6, further comprising a tool, associated with one of the first and second clamping members, for performing an operation on the workpiece.

10. The end effector of claim 9, wherein the tool comprises a riveting tool.

11. An end effector for a robotic arm, comprising:

a mount, linearly moveably mountable on the robotic arm;

a biasing device, configured to counterbalance the mount upon the robotic arm;

first and second clamping members, attached to the mount with a space therebetween, the first clamping member being linearly moveable in opposition to the second clamping member, movement of the first clamping member into contact with a workpiece in the space causing opposing linear movement of the mount and thereby drawing the second clamping member into opposing clamping contact with the workpiece; and a tool, associated with one of the first and second clamping members, for performing an operation on the workpiece while the workpiece is clamped between the first and second clamping members.

12. The end effector of claim 11, wherein:

the mount comprises a frame assembly, having first and second frame portions; and the first and second clamping members are respectively mounted on the first and second frame portions.

13. The end effector of claim 12, wherein:

the mount includes a slide; and the second frame portion is slideably mounted on the robotic arm by the slide.

14. The end effector of claim 12, wherein the first frame portion is slideably mounted on the second frame portion.

15. The end effector of claim 12, further comprising:

a drive, connected with the first clamping member for moving the first clamping member into contact with the workpiece.

16. The end effector of claim 12, further comprising a sensor, configured for sensing relative positions of the first and second frame portions.

17. The end effector of claim 11, further comprising a sensor, configured for sensing relative positions of the first and second clamping members.

18. The end effector of claim 11, wherein the tool comprises a riveting tool.

* * * * *